US008381497B2

(12) United States Patent
Scheibel et al.

(10) Patent No.: US 8,381,497 B2
(45) Date of Patent: Feb. 26, 2013

(54) METHOD AND PACKAGING MACHINE FOR PACKAGING PRODUCTS

(75) Inventors: Stefan Scheibel, Memmingen (DE); Armin Beckel, Memmingen (DE)

(73) Assignee: Multivac Sepp Haggenmuller GmbH & Co. KG, Wolfertschenden (DE)

( * ) Notice: Subject to any disclaimer, the term of this patent is extended or adjusted under 35 U.S.C. 154(b) by 368 days.

(21) Appl. No.: 12/902,507

(22) Filed: Oct. 12, 2010

(65) Prior Publication Data

US 2011/0083401 A1 Apr. 14, 2011

(30) Foreign Application Priority Data

Oct. 13, 2009 (DE) ..... 10 2009 049 179

(51) Int. Cl.
*B65B 57/12* (2006.01)
*B65B 7/28* (2006.01)
*B65B 9/04* (2006.01)

(52) U.S. Cl. ..... 53/449; 53/453; 53/471; 53/478; 53/51; 53/58; 53/170; 53/559; 53/282

(58) Field of Classification Search ..... 53/433, 53/449, 453, 471, 478, 51, 58, 74, 511, 170, 53/559, 561, 282, 329.2, 329.3; 426/119, 426/120, 398
See application file for complete search history.

(56) References Cited

U.S. PATENT DOCUMENTS 2,527,919 A * 10/1950 Drangle ..... 426/120
3,017,729 A * 1/1962 Cheeley ..... 53/478
3,055,246 A * 9/1962 Steinberg ..... 53/58
3,481,100 A * 12/1969 Bergstrom ..... 53/433
3,533,215 A * 10/1970 Ollier ..... 53/559
3,851,441 A * 12/1974 Marchand ..... 53/170
3,908,333 A * 9/1975 Cavanna ..... 53/51
4,069,348 A * 1/1978 Bush ..... 426/119
4,114,758 A * 9/1978 Coleman ..... 53/433
4,656,042 A * 4/1987 Risler ..... 426/398
4,868,759 A * 9/1989 Ross et al. ..... 53/51
5,025,611 A * 6/1991 Garwood ..... 53/511
5,101,611 A * 4/1992 Biskup et al. ..... 53/433
5,103,618 A * 4/1992 Garwood ..... 53/433
5,632,134 A * 5/1997 Noel et al. ..... 53/433
7,610,736 B2 11/2009 von Seggern

FOREIGN PATENT DOCUMENTS

DE 10 2005 048 491 B4 4/2008
EP 1 935 789 A1 6/2008

OTHER PUBLICATIONS

EPO machine translation of DE 102005048491, retrieved from Espacenet.com, Dec. 4, 2012, 6 pages.*

* cited by examiner

*Primary Examiner* — Stephen F Gerrity
(74) *Attorney, Agent, or Firm* — Husch Blackwell LLP

(57) ABSTRACT

A method for producing a package using a traysealer is provided, wherein the package includes a container, at least two sealing films and a plurality of products, of which a first product is located in the container and a second product between two sealing films. The first product is moved into the container upstream of a sealing station, the second product is moved onto a first sealing film before the container, the sealing film and the products are supplied together with a second sealing film, which is located above the first sealing film, to the sealing station. The first sealing film moves above and spaced apart from the container and the first product until the sealing station is reached. In the sealing station the container, the first sealing film and the second sealing film are subsequently sealed to one another.

16 Claims, 7 Drawing Sheets

METHOD AND PACKAGING MACHINE FOR PACKAGING PRODUCTS

CROSS-REFERENCE TO RELATED APPLICATIONS

This application claims foreign priority benefits under 35 U.S.C. §119(a)-(d) to German patent application number DE 102009049179.1, filed Oct. 13, 2009, which is hereby incorporated by reference in its entirety.

TECHNICAL FIELD

The present disclosure relates to a method and a packaging machine for packing products.

BACKGROUND

Both in the food sector and in the non-food sector, packages are getting more and more complex in order to satisfy the consumers' wishes.

DE 102005048491 B4, for instance, discloses an application in which not only one layer of staggered sausage slices is vacuum-packed in a non-perishable way with the help of a thermoformer, not a traysealer, but two layers of staggered sausage slices are to be packed into one joint package and are also to be opened individually prior to consumption. This is accomplished with a three-film package, in the case of which a first product layer is placed on a first film, a second film is subsequently placed or supplied and a second product layer is placed or supplied in a further station on or to the films positioned thereunder with interposed product. A third film is subsequently positioned. These three films, each with products being positioned between two films, are transported into a sealing station, evacuated, jointly sealed relative to each other and then isolated. This constitutes a flat pack.

EP 1935789 A1 discloses a traysealer for producing a package consisting of a container, an inserted product and a first film which as a skin film abuts on the product and on the insides of the container. Said first film holds the product in the container, simultaneously presenting the product in a very positive way. Sealing under a modified atmosphere is carried out in a first sealing station. Subsequently, a second sealing film is sealed in a second sealing station horizontally above onto the container to offer the option to apply labels or product information. It is pointed out that further products can be accommodated in the space between the first skin film and the second sealing film. This type of traysealer is complex and expensive due to its design with two sealing stations.

Consumers increasingly desire attractive packages with different products, e.g. a salad with a salad dressing pack or cutlery and napkin in combination with a ready-to-eat meal, packed in a non-perishable and transportable way, or products with separately packed instruction leaflet within a package.

SUMMARY

It is an object of the present disclosure to provide a method and a packaging machine that are capable of producing a package consisting of more than two films and more than two different products, and that are usable in an industrial environment with high efficiency and thus in a cost-saving manner.

In a method according to the present disclosure, a package is produced by means of a traysealer, the package consisting of a tray-shaped container, at least two sealing films and a plurality of products, of which one product is located in the container and another product between two sealing films, wherein the products are moved into the container upstream of a sealing station and onto the first sealing film and are subsequently supplied with a second sealing film jointly to the sealing station and are subsequently sealed to one another. Here, the first sealing film extends above and spaced-apart from the container and the product, and they are only united in the sealing station. This can be carried out by means of a sealing film extending in parallel above the container or by means of a sealing film guided laterally relative to the transport area of the container. The joining together with the second sealing film is only carried out in the sealing station.

Embodiments of the present disclosure permit the use of only one single sealing station. Hence, costs as well as space requirement can be reduced.

The required space can additionally be reduced in a variant having two insertion portions positioned one on top of the other and used for inserting the products into the container and by the placement of further products on a sealing film.

Owing to the spacing of the container and the product contained therein from the first sealing film upstream of the sealing station, it is still possible to convey the container independently of the sealing film into the sealing station. Hence, different processes can simultaneously take place during transportation of container and sealing film for enhancing the performance of the traysealer or for keeping it at a high level, respectively.

The spacing additionally permits the packaging of products that project beyond the upper edge of the container.

Here, a spacing between the first sealing film and the product placed thereon relative to a second sealing film permits the movement of the sealing films at different speeds at the same time. Hence, the movements can be carried out in a gentle way for film, product and drive system.

In this method the first sealing film is not supported by the container extending under said film. Should a support of the sealing film be needed due to the weight or dimension of the product on the sealing film, this can be accomplished by support sheets or rolls of a preferably small diameter so as to give the opening degree of the sealing station between upper and lower part of the sealing tool not an unnecessarily large size. The closing and opening times of the sealing station are kept correspondingly short.

In the sealing station it is then possible to generate a joint or also a separate and/or a different atmosphere by evacuation and/or gassing for the respective space between the container and the sealing films. The container and the films are sealed in a sealing operation with the container and films being correspondingly qualified due to the material properties and the ambient conditions, such as pressure, temperature and sealing duration.

To orient the products placed on the first sealing film on said film in such a manner that they cannot slip at an intermittent work cycle and at the ensuing high accelerations and speeds, a device may be provided that fixes the products on the film. Otherwise, this might have the consequence that in the sealing station the product is not transported in the portion intended for sealing, and the manufacture of said pack is tantamount to waste.

In a possible embodiment a gluing device can apply an adhesive dot to the sealing film or the product for the above-mentioned purpose, and a robot arm can supply the product to the sealing film.

The device used for fixing may be a gluing device that glues the product to the sealing film, or it may be a labeling station that with the help of labels secures the product, such as instruction leaflet or cutlery, on the sealing film. It is also conceivable that the product itself has the property to adhere to the sealing film, such as e.g. staggered sausage slices. Likewise, there is provided a variant in which the side of the sealing film accommodating the product exhibits a special property, such as e.g. grip.

Moreover, the film may have troughs into which products can be inserted.

To supply the products in the container and on the sealing film in the sealing station in a way that they fit each other, a register mark control system can ensure that, based on a register mark on the sealing film, the products are placed on said film. On the basis of the register mark, the film transport of the sealing film into the sealing station may also take place. This ensures that there is no misplacement of the sealing film with the product in the sealing station as this might lead to damage to the sealing tools and thus also to downtimes needed for eliminating this problem and for cleaning or repairing components of the sealing station.

It may also be intended that the products are applied to the sealing film at a minimum distance in transport direction and that a sensor system arranged in front of or in the sealing station detects the position of the products and gives this information to a controller, which thereby controls the drive of the transport system of the sealing film and thus the position of the product on the sealing film relative to the position of the product in the container or the container itself so as to position the product in the sealing station in a corresponding way. This further offers the advantage of the use of a simple and advantageous film and of a simple device for applying the products to the sealing film.

To obtain an optically appealing package, it may be necessary that the sealing film is deformed in a molding station disposed upstream of the sealing station and the insertion station such that said deformation fits the product, e.g. forms two neighboring troughs for two products, such as knife and fork of plastics. In this instance no additional measure is required for fastening the products to the sealing film because the lateral shapes of the trough ensure a definite position and the product remains safely retained therein. Should the product project beyond the container, it makes sense to deform, on the one hand, the sealing film to fit the shape and projection of the product and to provide, on the other hand, the above-mentioned troughs for the second product layer in the sealing film.

As a further particular feature, the second sealing film can also be thermoformed by a molding station of its own—in this case, preferably fitting the product on the first sealing film or the projection of the product beyond said sealing film—so as to produce an even more attractive package.

A further variant of the method may use a sealing film that has skin or shrink properties, the latter standing for shrink rates of more than 20%. This can also lead to a conspicuous attractive package.

The traysealer according to the present disclosure is suited for the above-described variant of the method.

There are no restrictions that would limit the number to tracks and rows or the number of containers in the sealing tool.

Two advantageous embodiments of the present disclosure will now be described in more detail with reference to a drawing.

BRIEF DESCRIPTION OF THE DRAWINGS

Like or similar components are always provided with like reference numerals in the figures.

DETAILED DESCRIPTION

Figure 1:
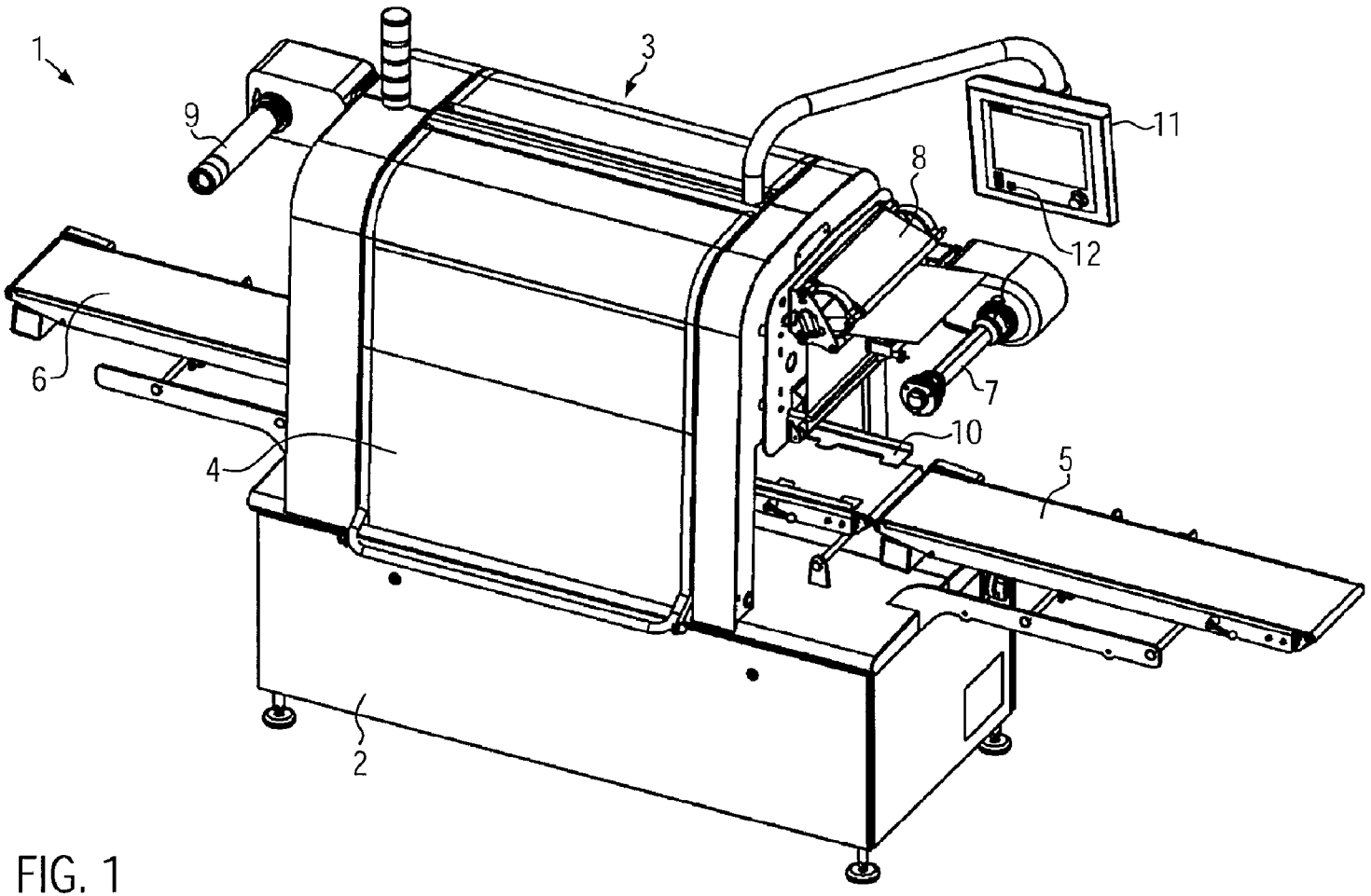
FIG. 1 is a perspective view of a traysealer according to the present disclosure.

FIG. 1 is a perspective view showing a traysealer according to the present disclosure. The traysealer 1 comprises a traysealer frame 2 on which a sealing or closing station 3 is arranged for closing and, if necessary, evacuating, gassing and/or sealing supplied tray-shaped containers and for cutting and closing used sealing films. The sealing station 3 is positioned underneath a hood 4 to be opened.

The traysealer 1 further comprises a supply belt 5 for supplying the containers, a discharge belt 6 for transporting the sealed containers, a film supply roll 7 for receiving and supplying a roll of a sealing film, a film tensioner 8 for tensioning the sealing film, and a residual film winder 9 for winding up the film residues remaining after sealing. If there are several sealing films, the residual film grids can be wound jointly onto one residual film winder or each onto a separate residual film winder. A gripper system 10 receives the tray-shaped containers from the supply belt 5 and transports them into the sealing station 3, and from there onwards to the discharge belt 6.

A display 11 enables an operator of the traysealer 1 to check and control the operation of the traysealer 1. For this purpose, control elements, for instance control panels or switches, may be provided on the display 11 so as to influence the operation of the traysealer 1.

Figure 2:
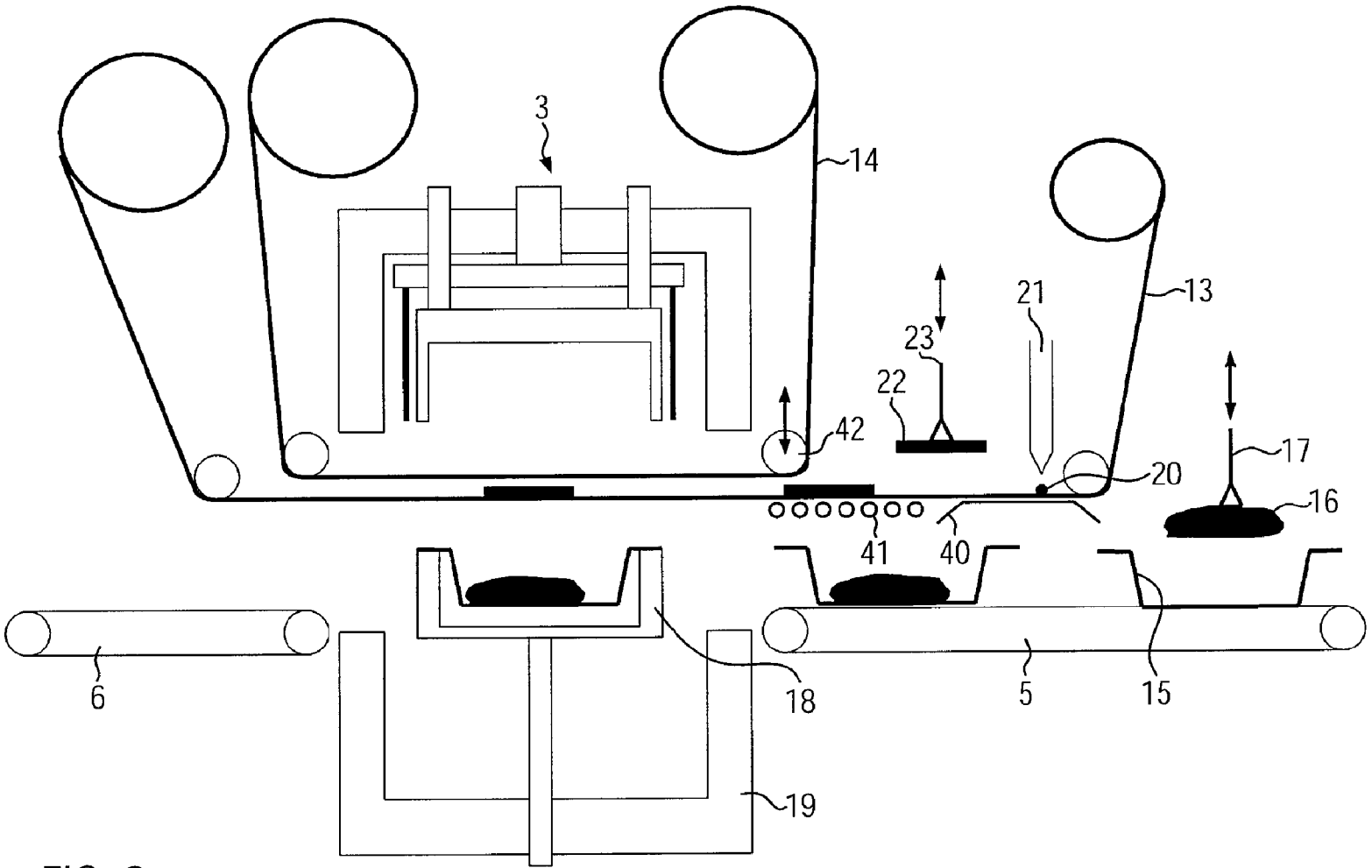
FIGS. 2-4 are schematic vertical sections through a first embodiment of the traysealer in different steps of a method according to the present disclosure.

In a first embodiment of the traysealer 1 according to the present disclosure, FIG. 2 schematically shows a vertical section through the sealing station 3. In contrast to the general standard equipment of the traysealer 1, as shown in FIG. 1, FIG. 2 shows two sealing films 13 and 14. Both are wound from rolls in the form of webs and supplied to the sealing station 3 and are each wound up by residual film winders 9. The two sealing films could also be unwound from a single roll and separated by a device (not shown) and spaced apart from each other. The containers 15 are transported on the supply belt 5 and are filled with a product 16 at an insertion station or area. This product 16 can e.g. be inserted by an operator, a filling device or, as outlined, by a robot 17 into the container 15. In the further process the container 15 which is filled with the product 16 is transported to the sealing station 3 and introduced via the gripper system 10, which is here no longer shown, into the container accommodating means 18 of the lower tool part 19.

As is further shown in FIG. 2, an adhesive dot 20 is applied by means of a gluing device 21 to the sealing film 13 so as to place a further product 22 on the sealing film 13 at a placement station or area, and to supply it to the sealing station 3. Product 22 can also be placed automatically via a robot 23. Instead of a gluing device 21, it is also possible to take other measures for transporting the product 22 in a positioned-oriented manner on the sealing film 13 into the sealing station 3.

As a support in the area of the gluing device 21, a support sheet 40 is shown and in the further course, as an alternative, a plurality of rolls 41 that preferably support the sealing film 13 over the whole film width.

To hold the product 22 on the first sealing film 13, the second sealing film 14 can be supplied in a variant (not shown) directly above the first sealing film 13 so that the second sealing film 14 exerts pressure from above on the product 22. This results in enhanced adhesion of the product to the first sealing film. In a preferred configuration the deflection roller 42 of the second sealing film 14 may here be configured to be vertically movable, so that the product 22 itself carries out the upward deflection of the deflection roller 42 while traveling thereunder. The deflection roller 42 itself may here be pretensioned towards the sealing film 14 (i.e. here downwards). In a variant with a motor drive of the movement of the deflection roller 42, the vertical movement function can be assumed by the controller or display 11 in response to the movement of the product 22.

Figure 3:
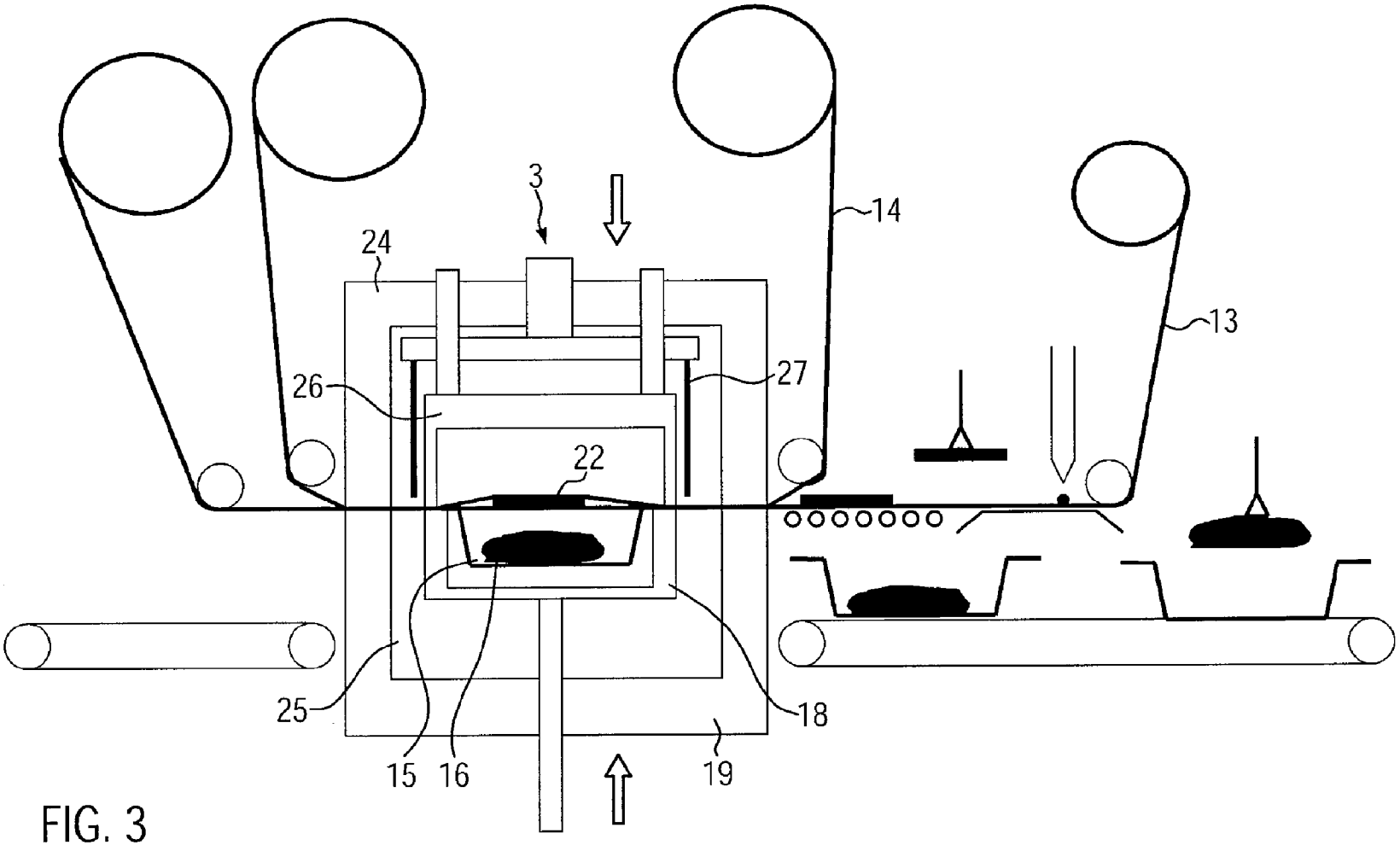

In FIG. 3, the container 15 with its product 16 and the sealing films 13 and 14 with the associated product 22 have been introduced into the sealing station, and the lower tool part 19 and the upper tool part 24 are closed by lifting systems (not shown) to form a chamber 25. The two sealing films 13 and 14 are here clamped all around. After a possible evacuation of the chamber 25 and/or after gassing the sealing operation is carried out by the upper part 26 of the sealing tool and the container receiving means 18. The two sealing films 13 and 14 are here tightly sealed to the container 15. The cutting system 27 separates the two sealing films near the sealing area, so that a single pack 28 is formed in which two different products, separated by means of films, are tightly sealed and presented in an optically appealing way.

Figure 4:
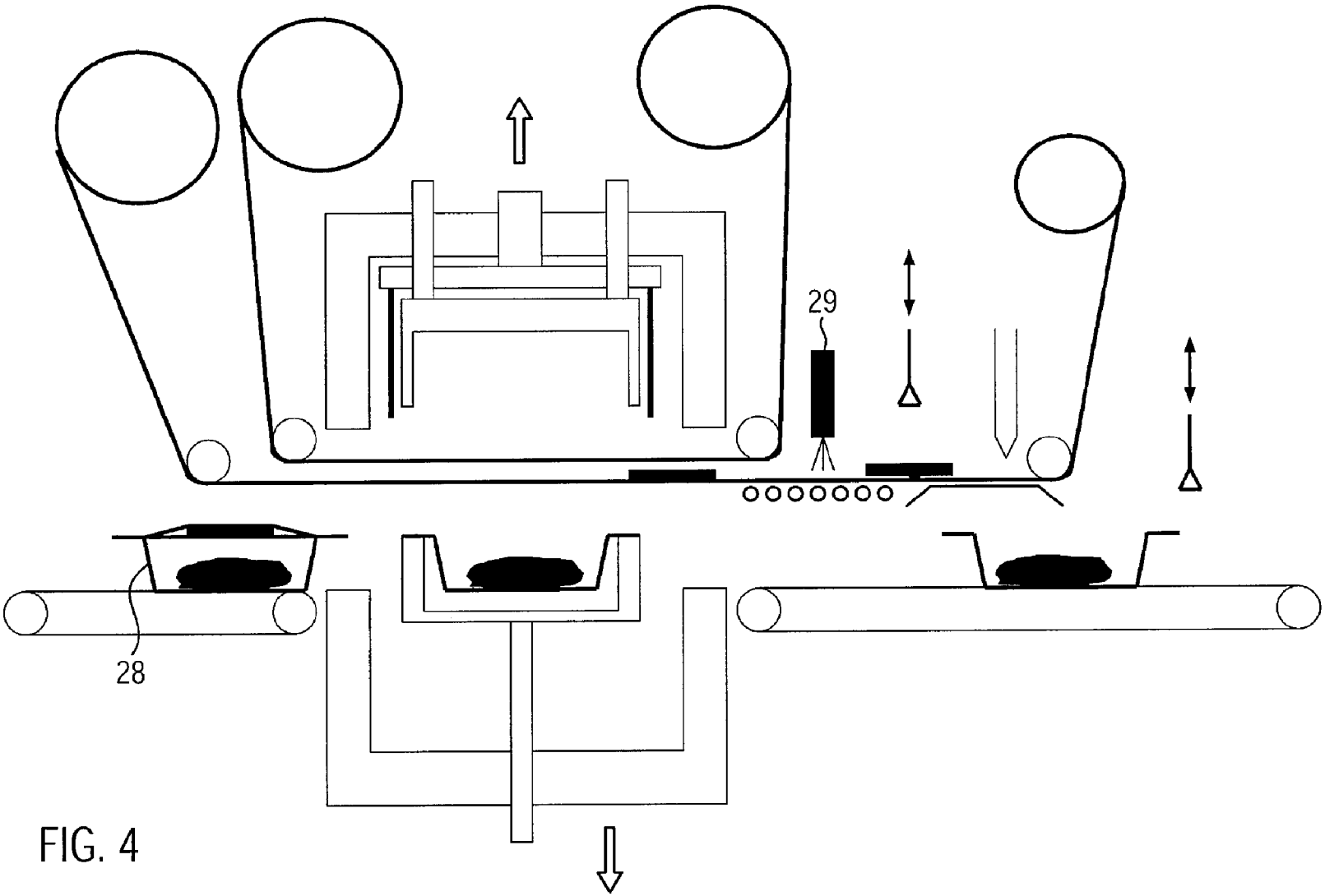

FIG. 4 shows the isolated pack 28 that has been transferred via the gripper system 10 from the sealing station 3 onto the discharge belt 6. The mode of operation of the traysealer 1 according to the present disclosure is intermittent, i.e., some work steps take place at the same time:

- insert product 16 into container 15
- apply adhesive dot 20 to sealing film 13
- place product 22 on sealing film 13
- supply sealing films 13 and/or 14 into the sealing station 3
- close sealing station 3, seal sealing films 13 and 14 on container 15
- transport container 15 via gripper system 10 into sealing station 3
- take out isolated pack 28 and continue transportation via the discharge belt 6.

To configure the position of the product 22 on the sealing film 13 in the sealing station 3 such that it is controllable, and thereby to maintain the same, a sensor system 29 can be mounted upstream of the sealing station 3 so as to detect the position of the product 22. Together with a controller (not shown) and the information of the sensor system 29, the sealing film 13 can be transported with the product 22 in an accurate position into the sealing station 3.

Figure 5:
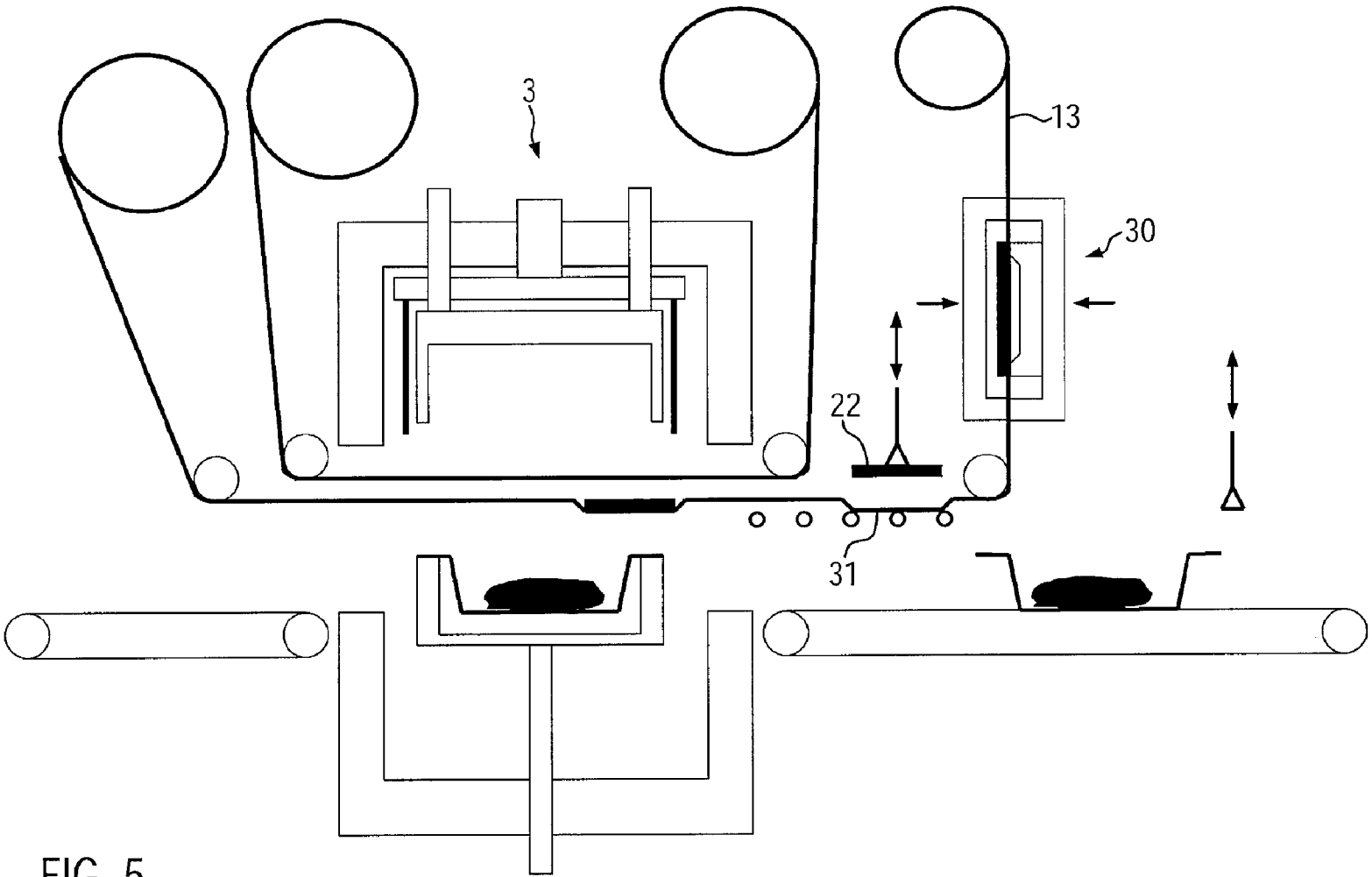
FIGS. 5-7 are schematic vertical sections through a second embodiment of the traysealer in different steps of the method according to the present disclosure.
Figure 6:
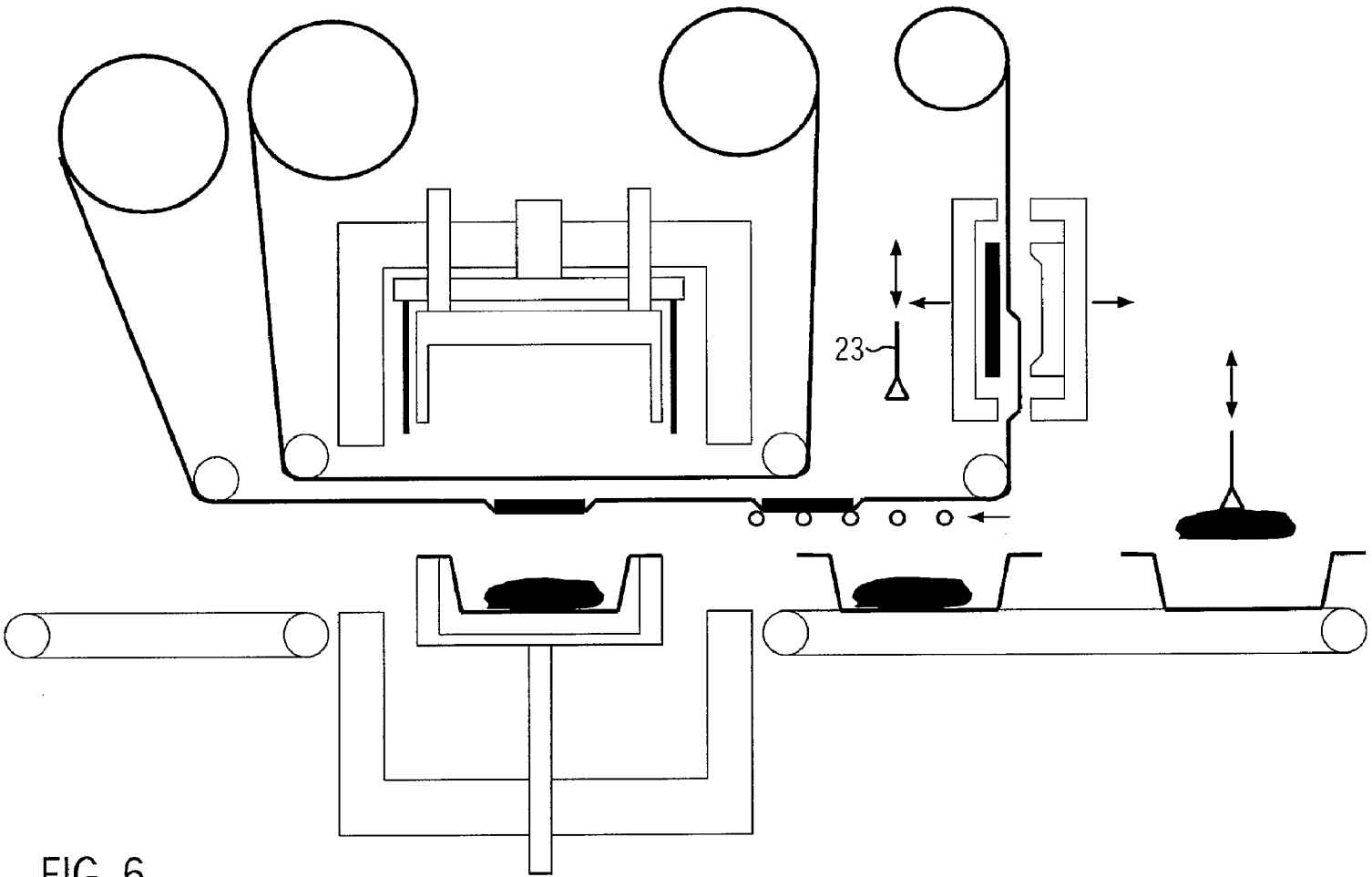
Figure 7:
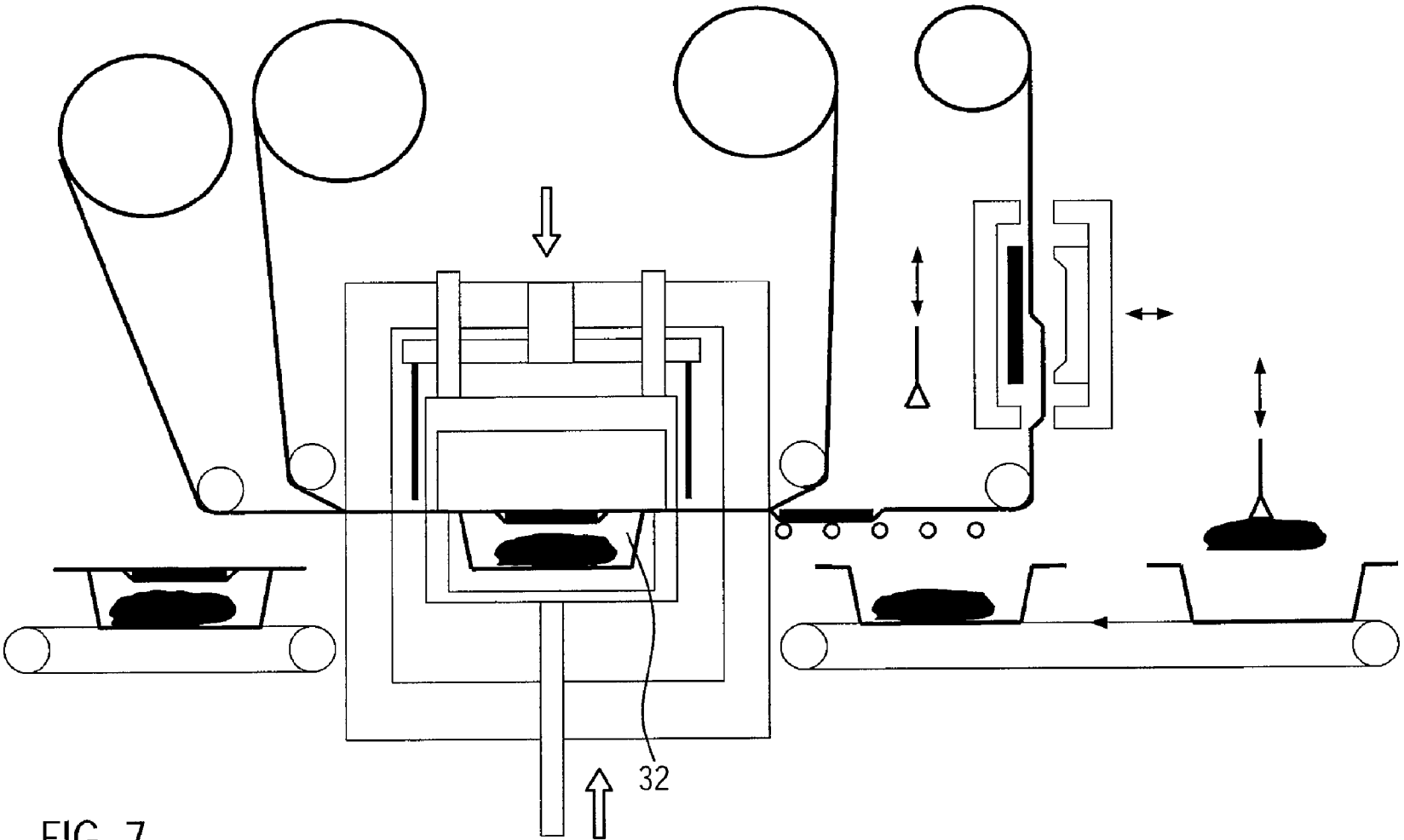

An alternative traysealer 1 according to the present disclosure is shown in FIGS. 5-7. A molding station 30 is here provided for the sealing film 13, the molding station forming troughs 31 into the sealing film 13 to match the product 22. This is carried out upstream of the insertion portion of the product 22 into the trough 31 and upstream of the sealing station 3. Hence, a device 21 for applying adhesives, e.g. an adhesive dot 20, can be omitted because the product 22 can be held via the lateral wall of the trough 31 during transportation. On account of the possible different shapes of the troughs 31, or for other reasons, such as application of a label including information on the product, it may be wise to take additional measures for fastening the product 22 in the trough 31.

In the variant with a molding station 30 for the sealing film 13, the position of the product 22 is determined via the trough 31, and the controller (not shown) controls the transportation of the sealing film 13 for a location-accurate positioning of the product in the sealing station 3.

In FIG. 6, the product 22 has been inserted via a robot 23 into the trough 31, and the product 16 is intended for insertion into the container 15, which container has been newly supplied on the supply belt 5.

As can be seen in FIG. 7, the second sealing film 14 ends flat and flush with the upper edge and the sealing plane of the container 15 because the first sealing film 13 with the product 22 is positioned inside the container 15. Such a package 32 is particularly suited to stack said package 28 repeatedly or to further package it in a space-saving way.

The traysealer 1 according to the present disclosure is not restricted to the two examples shown, but e.g. further means are here also conceivable that place the product 22 on the sealing film 13 and secure the product for further transportation.

While embodiments of the invention have been illustrated and described, it is not intended that these embodiments illustrate and describe all possible forms of the invention. Rather, the words used in the specification are words of description rather than limitation, and it is understood that various changes may be made without departing from the spirit and scope of the invention.

What is claimed is:

1. A method for producing a package using a tray-sealer, wherein the package includes a container, a first sealing film, a second sealing film, a first product and a second product, wherein the first product is located in the container and the second product is located between the first and second sealing films, the method comprising:

moving the first product into the container upstream of a sealing station;

moving the second product onto the first sealing film;

subsequently supplying the first and second sealing films to the sealing station with the second sealing film located above the first sealing film and the second product on the first sealing film, wherein the first sealing film with the second product thereon moves above the container and the first product and remains spaced apart from the first product and/or the container until the sealing station is reached; and sealing the container with the first product, the first sealing film with the second product thereon, and the second sealing film to one another in the sealing station.

2. The method according to claim 1 wherein moving the second product onto the first sealing film comprises placing the second product onto the first sealing film in a position-oriented manner using a device.

3. The method according to claim 2 wherein moving the second product onto the first sealing film is controlled via a register mark control system.

4. The method according to claim 2 further comprising sensing by a sensor system the second product on the first sealing film upstream of the sealing station, and subsequently controlling by a controller the position of the first sealing film to match the location of the container in the sealing station.

5. The method according to claim 1 wherein moving the second product onto the first sealing film is controlled via a register mark control system.

6. The method according to claim 1 further comprising sensing by a sensor system the second product on the first sealing film upstream of the sealing station, and subsequently controlling by a controller the position of the first sealing film to match the location of the container in the sealing station.

7. The method according to claim 1 wherein the first sealing film is deformed to accommodate the second product.

8. The method according to claim 1 wherein the second sealing film is deformed prior to being supplied into the sealing station.

9. The method according to claim 1 further comprising deforming the first sealing film upstream of the sealing station to form a trough for receiving the second product.

10. The method according to claim 1 wherein at least one of the sealing films is a skin film or a shrink film.

11. A tray-sealer for producing a package, the tray-sealer comprising:

an insertion area for inserting a first product into a container;

a placement area for placing a second product on a first sealing film; and a sealing station that receives, in an unsealed condition, the container with the first product, the first sealing film with the second product placed thereon such that the first sealing film extends between the container and the second product, and a second sealing film located above the first sealing film with the second product thereon, wherein the sealing station is operable to seal the container with the first product, the first sealing film with the second product thereon, and the second sealing film together; and wherein the sealing station is configured to receive the first sealing film with the second product thereon, and the container with the first product, such that the first sealing film with the second product thereon moves above the container and the first product and remains spaced apart from the first product until the sealing station is reached.

12. The tray-sealer of claim 11 wherein the placement area comprises a device for placing the second product onto the first sealing film in a position-oriented manner.

13. The tray-sealer of claim 11 further comprising a register mark control system for controlling placement of the second product onto the first sealing film.

14. The tray-sealer of claim 11 further comprising a sensor system for sensing the second product on the first sealing film upstream of the sealing station, and a controller for controlling the position of the first sealing film to match the location of the container in the sealing station.

15. The tray-sealer of claim 11 further comprising a molding station for deforming the first sealing film upstream of the sealing station to form a trough for receiving the second product.

16. The tray-sealer of claim 11 wherein at least one of the sealing films is a skin film or a shrink film.

* * * * *

UNITED STATES PATENT AND TRADEMARK OFFICE

CERTIFICATE OF CORRECTION

PATENT NO. : 8,381,497 B2
APPLICATION NO. : 12/902507
DATED : February 26, 2013
INVENTOR(S) : Stefan Scheibel and Armin Beckel It is certified that error appears in the above-identified patent and that said Letters Patent is hereby corrected as shown below:

Title page, item (73) should read Assignee: Multivac Sepp Haggenmuller GmbH & Co. KG, Wolfertschwenden (DE)

Signed and Sealed this
Fourth Day of June, 2013

Teresa Stanek Rea

Teresa Stanek Rea
*Acting Director of the United States Patent and Trademark Office*